US005893521A

United States Patent [19]

Bertain

[11] Patent Number: 5,893,521

[45] Date of Patent: Apr. 13, 1999

[54] HOT WATER SAFETY DISCHARGE NOZZLE

[76] Inventor: John Paul Bertain, 1317 Buhne St., Eureka, Calif. 95501

[21] Appl. No.: 08/753,023

[22] Filed: Nov. 19, 1996

[51] Int. Cl.[6] ..... B05B 17/04

[52] U.S. Cl. ..... 239/11; 239/500; 239/554; 137/312; 137/331; 126/389

[58] Field of Search ..... 239/110, 120, 239/121, 122, 500, 548, 553, 553.5, 554, 555, 11, 501; 126/344, 361, 389; 137/312, 334

[56] References Cited

U.S. PATENT DOCUMENTS

| | | | |
|---|---|---|---|
| 441,365 | 11/1890 | Kinder | 239/554 X |
| 592,447 | 10/1897 | Richardson | 239/501 X |
| 1,515,766 | 11/1924 | Astren | 239/555 |
| 2,047,654 | 7/1936 | Te Pas | 137/73 |
| 2,200,124 | 5/1940 | Sands | 137/73 |
| 2,271,786 | 2/1942 | Watkins | 137/73 |
| 2,295,154 | 9/1942 | Brower | 137/73 |
| 2,475,777 | 7/1949 | Brown | 239/110 X |
| 2,701,738 | 2/1955 | Cerasi | 239/554 X |
| 2,923,797 | 2/1960 | Thelen | 126/361 X |
| 3,069,671 | 12/1962 | Taylor | 137/312 X |
| 4,212,335 | 7/1980 | Bova | 141/382 |
| 4,221,228 | 9/1980 | Stoffel et al. | 239/110 X |
| 4,352,365 | 10/1982 | Boccardo et al. | 137/68 |
| 4,457,329 | 7/1984 | Werley et al. | 137/73 |
| 4,458,711 | 7/1984 | Flider | 137/71 |
| 4,598,694 | 7/1986 | Cromer | 126/361 |
| 4,700,894 | 10/1987 | Grzych | 239/555 |
| 4,805,662 | 2/1989 | Moody | 137/312 |
| 5,174,610 | 12/1992 | Svendsen et al. | 285/13 |

FOREIGN PATENT DOCUMENTS

| | | | |
|---|---|---|---|
| 1607963 | 11/1990 | U.S.S.R. | 239/555 |
| 1713660 | 2/1992 | U.S.S.R. | 239/554 |

OTHER PUBLICATIONS

Copies of packaging for a ¾" brass foot valve with ABS strainer, manufactured by Clayton Mark, Inc., Rogers, Arizona 72756, date unknown.

Copies of packaging and brochure for a ¾" foot valve with strainer, manufactured by Brady Products, Inc., Clearwater, Florida, date unknown.

Copy of packaging for a ¾" brass foot valve with strainer, manufactured by WaterWorker, Mansfield, Ohio 44905, date unknown.

Color Photo of ¾" black foot valve screen, date unknown.

Information Bulletin 95–15 (SHL), Department of Housing and Community Development, Division of Codes and Standards, Sacramento, California, Nov. 30, 1995.

Ace Label for "T & P Valve", Ace 44988, Ace Hardware Corp., ©1995.

*Primary Examiner*—Andres Kashnikow
*Assistant Examiner*—Steven J. Ganey
*Attorney, Agent, or Firm*—Townsend and Townsend and Crew LLP

[57] ABSTRACT

The invention provides a hot water safety discharge nozzle and a water heater pressure/temperature relief discharge system having such a nozzle. The nozzle results in the decrease of both the pressure and temperature of the discharged water by spraying the water as small droplets. Generally, the nozzle includes a cap with a weep hole, wherein the cap substantially blocks the stream of discharge water, and a series of metered radial orifices which break the discharge stream up into small particles, and distribute those particles radially. The ambient air surrounding the nozzle cools the small droplets as they travel from the nozzle. Additionally, the perforate nozzle structure prevents insects and rodents from entering and nesting within the pipe, and also eliminates the danger of small objects, including human fingers, from blocking the discharge pipe.

13 Claims, 2 Drawing Sheets

HOT WATER SAFETY DISCHARGE NOZZLE

BACKGROUND OF THE INVENTION

The present invention relates generally to the safe discharge of high temperature fluids, and in particular, provides a safety discharge nozzle which expels a high temperature and/or high pressure stream of water as small droplets so as to promote cooling of the hot water and prevent the hot water from splashing, particularly when water is discharged to relieve over-pressure or over-temperature of a hot water heater.

Common residential and commercial water heaters generally include a tank in which the heated water is stored until required for use. The temperature and pressure of the water stored within the tank will typically vary within predetermined limits when the water heater operates normally. However, when a malfunction occurs, the temperature and/or pressure of the water stored within even a common residential water heater is capable of inflicting severe damage. If the tank itself should fail, for example, due to excessive pressure in the water supply, boiling of the water, or age, high temperature water may be spread explosively from the tank over a considerable distance. Even in the case of a failure which results in a slow leak of hot water, that water could potentially pool around the water heater, requiring expensive repairs of the surrounding articles and structure.

To avoid these catastrophic results, common residential and commercial water heaters generally include a relief valve which releases water when temperature and/or pressure of the water within the tank exceeds a predetermined value. The relief valve is often connected to a discharge pipe, which releases the heated water into a reservoir. The reservoir is typically provided with a drain to minimize water damage. A wide variety of relief valves and drain systems are commercially available.

While known relief valves are a significant and well known safety feature of common water heaters, the discharge and drainage of the water released by existing relief valves can still be problematic. Typically, the discharge pipe simply terminates with an open end which points down into the reservoir. While this arrangement may prove effective in many circumstances, persons and/or property near the drainage system may still be put at risk when the relief valve actuates.

For the above reasons, it would be desirable to provide an enhanced discharge apparatus for safely discharging the water from a water heater. It would be particularly desirable if that improved apparatus were adapted for use with existing water heaters and known water heater relief valves. Ideally, such an apparatus should be low in cost and readily retro-fittable on existing installations to enhance their reliability and safety.

SUMMARY OF THE INVENTION

The present invention provides a hot water safety discharge nozzle for attachment to the end of a pressure/temperature relief discharge pipe. The nozzle results in the decrease of both the pressure and temperature of the discharged water by spraying the water as small droplets. Generally, the nozzle includes a cap substantially blocking the stream of discharge water and a series of metered radial orifices which break the discharge stream up into small particles, and which distribute those particles radially. The ambient air surrounding the nozzle then cools the small droplets as they travel from the nozzle. This structure helps to avoid the discharge stream from violently striking water pooled within any reservoir, and thereby avoids splashing large masses of the water outward to the surrounding environment. Cooling takes place when water discharges from the hot water safety discharge nozzle to the reservoir. Additionally, the perforate nozzle structure provides a safety device which prevents insects and rodents from entering and nesting within the pipe, and also eliminates the danger of small objects (including human fingers) from being lodged in the end of the discharge pipe.

In a first aspect, the present invention provides a hot water safety discharge nozzle comprising a body having a proximal end and a distal end and which defines an axis therebetween. The body is adapted to extend distally from a hot water discharge pipe of a hot water heater. When it is released from the discharge pipe, the hot water is received in an axial cavity of the body. A cap is disposed distally of the body and substantially blocks the distal end of the axial cavity. A perforate structure disposed between the body and the cap defines a plurality of radial openings. These openings divide the hot water into small droplets so as to promote cooling of the hot water and prevent the hot water from splashing upward when it is expelled from the discharge nozzle.

Preferably, the radial openings are formed as circumferential slots, the perforate structure ideally comprising a series of annular rings (or ring segments) supported on axially oriented structures that extend between the body and the cap. Typically, the body includes threads to provide an easy attachment between the nozzle and a hot water discharge pipe.

In another aspect, the present invention provides a hot water safety discharge system comprising a discharge valve, a discharge pipe, and a discharge nozzle. The discharge valve releases hot water from a hot water heater when at least one of a pressure and a temperature of the water exceeds a predetermined limit. The pipe extends downward from the discharge valve, and the discharge nozzle comprises a body which extends downward from the discharge pipe, the body defining an axial cavity. A cap is disposed distally of the body and substantially blocks the distal end of that axial cavity. A perforate structure disposed between the body and the cap defines a plurality of radial openings.

Generally, an overflow reservoir surrounds the radial openings of the perforate structure, and the perforate structure divides the hot water into small, slow moving droplets so as to promote cooling of the hot water and prevent the hot water from splashing upward and out of the overflow reservoir. Additionally, the perforate structure blocks objects which might otherwise obstruct the flow of hot water from exiting the discharge pipe.

DETAILED DESCRIPTION OF THE SPECIFIC EMBODIMENTS

Figure 1:
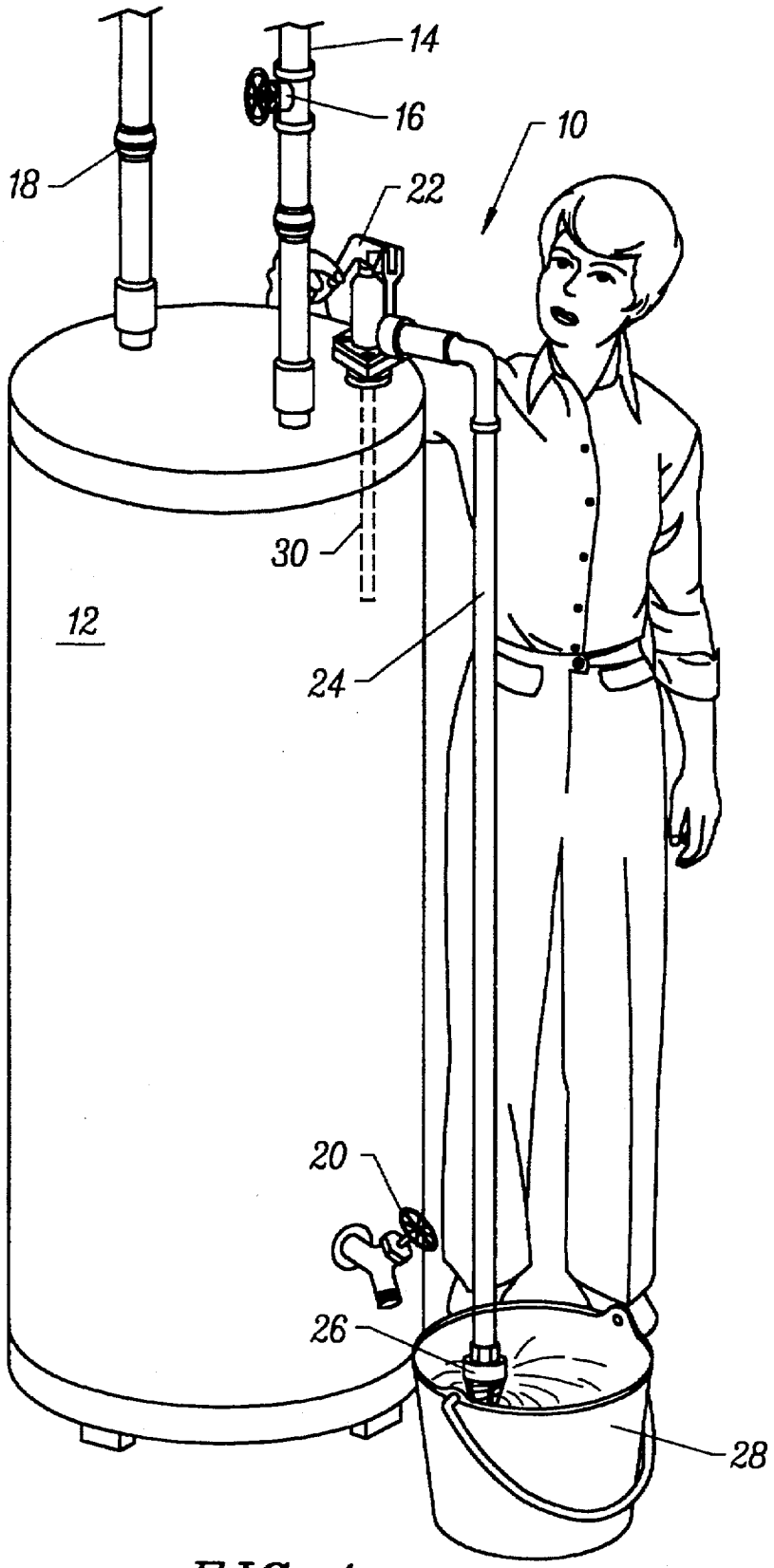
FIG. 1 illustrates a hot water safety discharge system coupled to a known water heater, according to the principles of the present invention.

Referring now to FIG. 1, a hot water safety discharge system 10 will generally be used with a water heater 12 as shown. The water heater will generally make use of cold water supplied by cold water inlet pipe 14 having a shut off valve 16, and will typically supply a hot water outlet pipe 18 from an internal tank. In some embodiments, no actual tank will be present in the water heater system, and the water will be heated only when the system senses water flowing from the inlet to the outlet pipe. Regardless, the water heater system will generally include a drain valve 20 and a port for coupling the water heater system to discharge system 10.

Discharge system 10 generally comprises a temperature/pressure relief valve 22, a discharge pipe 24, a safety discharge nozzle 26, and a reservoir 28. Relief valve 22 will generally discharge water when the water within the water heater system exceeds a predetermined safe temperature and/or pressure. Ideally, the discharge valve will release water when either temperature or pressure is excessive, thereby ensuring integrity of the remainder of the water heater system.

The relief valve will typically include a heat sensing probe 30 extending into the water tank, as is generally known in the art. Additionally, to help ensure that the relief valve is operating properly, a manual relief actuation lever is typically included. A wide variety of relief valve structures can be used with the safety discharge system of the present invention, including those sold by Ace Hardware of Oakbook, Ill., as T&P Valve #44988.

By operation of the relief valve, when the hot water heater malfunctions, the pressurized hot water or steam will be forced through the temperature pressure relief valve and down the attached discharge pipe. The discharge pipe is typically directed toward the floor or an approved drain. Optionally, the discharged water is collected in a reservoir, shown here as a simple bucket. Ideally, the water is collected in the reservoir and drained to prevent water damage if the discharge of water from the water heater is not stanched almost immediately.

At the distal end of discharge pipe 24, safety nozzle 26 disperses the water as a fine spray of relatively slow moving droplets. As the droplets travel from the nozzle through the surrounding atmosphere, they are cooled to a temperature which is safe for modern plastic drain piping. Additionally, the droplets are typically radially oriented, each have relatively little kinetic energy to splash the previously discharged water out of the reservoir or up onto surrounding persons and property.

Figure 2:
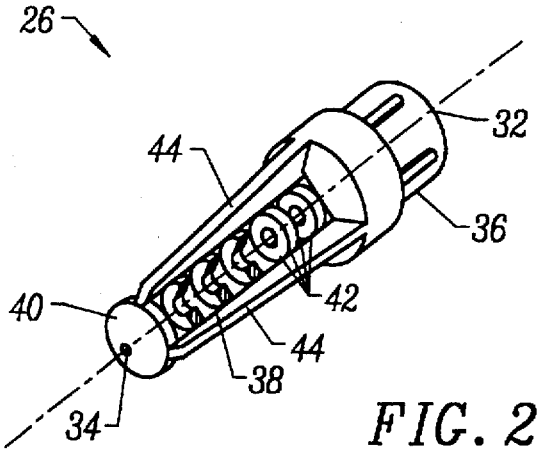
FIG. 2 is a perspective view of a safety discharge nozzle, in which portions of some of the annular rings have been removed to illustrate the axial chamber therein.

Referring now to FIG. 2, safety discharge nozzle 26 generally has a proximal end 32 and a distal end 34 so as to define an axis as shown. A body 36 is located near the proximal end and typically includes internal threads for coupling the discharge nozzle onto the end of discharge pipe. The body is generally hollow, defining an internal cavity 38 which extends distally to a cap 40. A series of rings 42 are located between the cap and the body, the rings and the cap being fixed in position relative to the body by supports 44.

Figure 3:
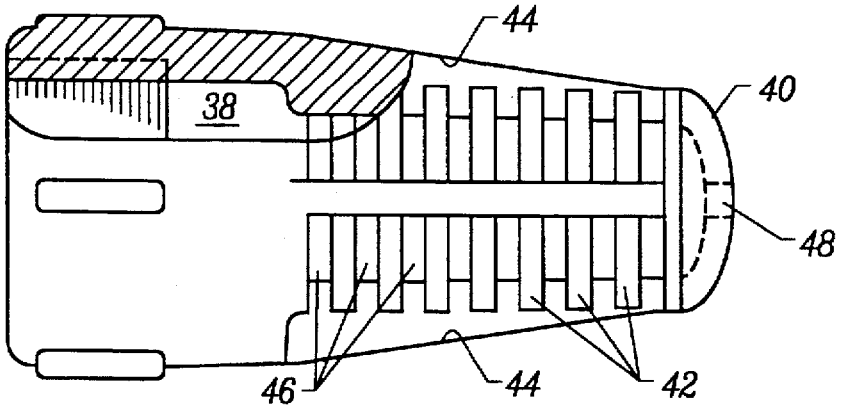
FIG. 3 is a side view of the safety discharge nozzle of FIG. 2, in which a portion of the body has been removed.
Figure 5:
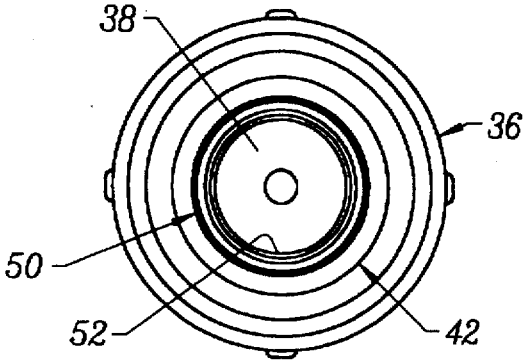
FIG. 5 is an end view from proximally of the body of the safety discharge nozzle of FIG. 2.
Figure 4:
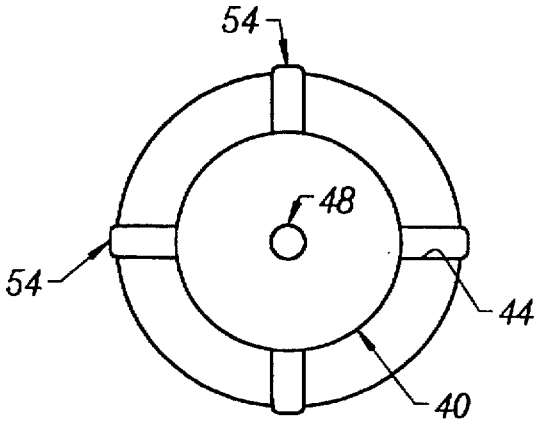
FIG. 4 is an end view from distally of the cap of the safety discharge nozzle of FIG. 2.

Referring now to FIGS. 3–5, the structure of the exemplary safety nozzle provides a plurality of radial openings 46 between rings 42. As the discharge nozzle will generally be installed with the cap oriented downward, these openings will generally be horizontally disposed, so as to disperse water droplets axially from the end of the pipe. Specifically, as the high temperature and high pressure water is discharged into cavity 38, the direct path for the hot water is blocked by the cap disposed at the distal end of the cavity. As pressure builds within the cavity, the water is redistributed through the open sides of the nozzle, the openings between the rings acting as metered orifices. These openings break the water into small droplets which are easily cooled as they travel through the ambient air.

Ideally, cap 40 includes a concave inner surface and a weep hole 48. Additionally, the inner diameter of the rings decreases slightly distally, so that the inner cavity 38 tapers from a first diameter 50 adjacent the proximal body, to a second diameter 52 (which is smaller than the first diameter) near the distal cap 40. This tapering cavity structure helps to evenly distribute the water throughout each of the openings along the cavity of the discharge nozzle.

In some embodiments, weep hole 48 may be threaded. Optionally, these threads could be used to attach a secondary perforate body about the openings 46 of safety discharge nozzle 26. This secondary perforate structure, which would preferably have a ring structure similar to (but larger than) the safety discharge nozzle, will further slow the droplets and cool the hot water stream. The secondary perforate structure will be roughly coaxial with safety discharge nozzle 26, and will ideally have an axial passage sized to provide a gap of between roughly ¼ to ½ inch therebetween.

Safety discharge nozzle 26 generally measures between about 2.0 and 5.0 inches in length, ideally measuring about 3.0 inches in length. The outer diameter of the nozzle body is generally under 2.0 inches, ideally being between about 1.0 and 1.75 inches in diameter. The inner surface of the body will include between about 0.5 and 1.0 inch of threads, the threads typically being in standard iron pipe sizes, and ideally being 0.75 inch female iron pipe threads.

Typically, between about 3 and 25 ring or ring segments will be disposed axially between the cap and body, ideally being between about 5 and 15. Each ring will typically be less than 0.2 inches in thickness, and the inner diameter of each ring will generally be less than 1.0 inch, ideally tapering between about 0.72 inches and 0.68 inches distally, as described above. Preferably, the gap between adjacent rings will be less than ⅛ of an inch, to discourage the entry of nesting insects, rodents, small human fingers, and the like. A series of radial protrusions 54 on the outer surface of the nozzle body facilitate threading the nozzle onto the distal end of the discharge pipe.

While the discharge nozzle of the present invention may comprise a wide variety of materials, it will generally include brass, copper, cast iron, galvanized malleable iron, galvanized wrought iron, galvanized steel, asbestos cement, CPVC, PE, PVC, or some other material approved within the Uniform Plumbing Code or by some regulatory agency. Preferably, the nozzle is formed of chlorinated poly-vinyl chloride, to provide a heat capability between 150° and 180° F., with a relatively low production cost, ideally comprising CPVC of a quality equivalent to that used in fire sprinkler systems.

To allow safety discharge nozzle 26 to be used with existing relief valves having ½ inch discharge outlets, a CPVC adapter could be used. The adapter would allow a ¾ inch pipe to connect to these existing valves, and would thereby facilitate retrofitting existing water heater installations. In some top mounted valve installations, a short CPVC tube and a CPVC elbow may be disposed between the relief valve and the downward oriented discharge pipe. Alternative installations may make use of a pipe which is directly attached to the valve.

While the exemplary embodiment of the present invention has been described in some detail, for purposes of clarity and understanding, the scope of the present invention shall be limited solely by the appended claims.

What is claimed is:

1. A hot water safety discharge system comprising:

a hot water discharge pipe having a proximal end and a distal end, the proximal end coupled to a water heater;

a body having a proximal end and a distal end and defining an axis therebetween, the body being coupled to extend distally from the hot water discharge pipe so that hot water from the discharge pipe is received in an axial cavity of the body;

a cap disposed distally of the body and substantially blocking the distal end of the axial cavity;

a perforate structure disposed between the body and the cap, the perforate structure defining a plurality of radial openings for dividing the hot water into small droplets so as to promote cooling of the hot water and prevent the hot water from splashing upward when the hot water is expelled from the hot water discharge pipe.

2. A hot water safety discharge nozzle as claimed in claim 1, wherein the cap has a weep hole opening to the axial cavity.

3. A hot water safety discharge nozzle as claimed in claim 1, wherein the radial openings comprise circumferential slots.

4. A hot water safety discharge nozzle as claimed in claim 1, wherein the perforate structure comprises a series of annular rings aligned coaxially around the cavity, the rings substantially defining the radial openings therebetween.

5. A hot water safety discharge nozzle as claimed in claim 4, further comprising at least one axially oriented support extending between the body and cap to affix the cap and the rings relative to the body.

6. A hot water safety discharge nozzle as claimed in claim 4, wherein the plurality of rings comprises between 3 and 25 rings.

7. A hot water safety discharge nozzle as claimed in claim 1, wherein the body comprises threads.

8. A hot water safety discharge system comprising:

a hot water discharge valve coupleable to a common residential water heater;

a hot water discharge pipe having a proximal end coupled to the hot water discharge valve and a distal end;

a body having a proximal end and a distal end and defining an axis therebetween, the body coupled to the distal end of the hot water discharge pipe so that hot water is received in an axial cavity of the body;

a cap disposed distally of the body and substantially blocking the distal end of the axial cavity;

a plurality of axially oriented supports extending between the body and cap;

a series of annular rings aligned coaxially around the cavity between the body and the cap, the rings affixed to the supports and axially separated to define a plurality of radial openings therebetween, such that the hot water is distributed through the openings as slow moving droplets.

9. A hot water safety discharge nozzle as claimed in claim 8, wherein an inner surface of the cap bordering the cavity is concave, and wherein the cap has an axial weep hole extending distally from the cavity to drain the hot water when the cap is disposed at the lower end of the cavity.

10. A hot water safety discharge nozzle as claimed in claim 8, wherein the cavity tapers inwardly distally to promote radial dispersion of the hot water through the openings.

11. A hot water safety discharge nozzle as claimed in claim 8, wherein the openings between the rings are less than ⅛ inch wide.

12. A hot water safety discharge system comprising:

a discharge valve which releases hot water from a water heater when at least one of a pressure and a temperature of the water exceeds a predetermined limit;

a discharge pipe extending downward from the discharge valve;

a body having a proximal end and a distal end and defining an axis therebetween, the body being coupled to extend downward from the discharge pipe, the body defining an axial cavity;

a cap disposed distally of the body and substantially blocking the distal end of the axial cavity;

a perforate structure disposed between the body and the cap, the perforate structure defining a plurality of radial openings; and an overflow reservoir surrounding the radial openings of the perforate structure, wherein the perforate structure divides the hot water into small, slow moving droplets so as to promote cooling of the hot water and to prevent the hot water from splashing upward and out of the overflow reservoir, and where the perforate structure blocks objects which might otherwise obstruct the hot water from exiting the discharge pipe.

13. A method for safely discharging water from a residential water heater, the method comprising:

mounting a safety discharge nozzle to a discharge pipe;

releasing hot water from within the water heater through a discharge valve when at least one of a pressure and a temperature of the water exceeds a predetermined limit;

directing the water from the discharge valve down to the safety nozzle through the discharge pipe so that the water is received in an axial cavity of the safety nozzle;

blocking the water axially within the axial cavity with a cap of the safety nozzle;

distributing the water radially through a perforate structure of the safety nozzle, the perforate structure disposed around the axial cavity and defining a plurality of radial openings so that the perforate structure divides the water into small, slow moving droplets and promotes cooling of the water;

collecting the droplets in an overflow reservoir surrounding the radial openings of the perforate structure;

wherein the perforate structure prevents the water from splashing upward and out of the overflow reservoir, and where the perforate structure blocks objects which might otherwise obstruct the hot water from exiting the discharge pipe.

* * * * *